United States Patent [19]

King

[11] Patent Number: 4,736,839

[45] Date of Patent: Apr. 12, 1988

[54] GARMENT BAG

[75] Inventor: William L. King, Denver, Colo.

[73] Assignee: Samsonite Corporation, Denver, Colo.

[21] Appl. No.: 947,666

[22] Filed: Dec. 30, 1986

[51] Int. Cl.[4] ..... A45G 13/26

[52] U.S. Cl. ..... 206/287.1; 206/289

[58] Field of Search ..... 190/13 C, 36, 903, 112, 190/111; 206/287, 287.1, 282

[56] References Cited

U.S. PATENT DOCUMENTS

| | | | |
|---|---|---|---|
| Re. 21,227 | 10/1939 | Richter | 206/282 |
| D 267,677 | 1/1983 | Pelavin | 206/287.1 X |
| 2,154,630 | 4/1939 | Marbury et al. | 206/287.1 X |
| 2,261,291 | 11/1941 | Salavsky | 206/287.1 X |
| 2,804,183 | 8/1957 | Breskin et al. . | |
| 2,839,167 | 6/1958 | Smith | 206/287.1 X |
| 3,115,959 | 12/1963 | Jaffe | 206/287.1 |
| 3,164,231 | 1/1965 | Kryznoski | 190/903 X |
| 3,175,658 | 3/1965 | Bierman | 190/112 X |
| 3,512,621 | 5/1970 | Teetor | 206/287 |
| 4,542,824 | 9/1985 | Allen | 190/111 X |

OTHER PUBLICATIONS

Marketing Material, "Dante II garment bag", date unknown.

Brochure, "Getting a Handle on Luggage", date unknown.

*Primary Examiner*—William Price

*Attorney, Agent, or Firm*—Gregory W. O'Connor

[57] ABSTRACT

A flexible garment bag of the type which can be hung or held vertically or which can be folded transversely midway between the ends and carried by a handle like a suitcase. The front of the bag has an access panel attached at the bottom by a fold to allow it to be moved to open position. Detachable connections allow the access panel to be closed. When closed, a handle on the outside of the access panel allows the bag to be carried like a suitcase. Unlike other designs which put the handle on the back panel, this arrangement permits suits to be loaded in the usual way, but when the bag is folded the suits are folded with the lapels up instead of down, thus limiting wrinkling. A rigid folding bar in the back panel of the bag facilitates folding of the bag and the hanging garments in the bag. In addition, corner pockets are located near the clothes hangers to assist in holding the clothes in place, criss-cross straps are provided for the same purpose, and straps at the bottom of the bag hold long garments in place. Further, the bag hanging hook extending from the top of the bag can be adjustably positioned to hold the bag in folded position.

21 Claims, 3 Drawing Sheets

10
12
14
16
18
20
24
26
28
30
32
34
38
40
42
44
46
48
49
50
52
54
56
58
60
66
68
70
72
74
76
78
80
9

GARMENT BAG

FIELD OF THE INVENTION

This invention relates to a flexible garment bag, and more particularly, it relates to a flexible garment bag of the type that can be folded upon itself to form a suitcase type of configuration.

BACKGROUND OF THE INVENTION

When packing the usual type of foldable garment bag, the empty open bag is either hung from a support or laid across a horizontal support, such as a bed. Garments supported on clothes hangers are inserted through the access panel and the hangers are set in place on a hanger support trolley. After the access panel is closed the bag is turned around to permit pockets on the opposite panel of the bag to be filled with smaller clothing items or accessories. Then, if it is desired to carry the bag in suitcase fashion, it is transversely folded so that the access panel is folded upon itself, with the opposite or back panel forming the exterior sides of the folded bag. In such an arrangement the bag is carried by a handle located at the midpoint of the back panel of the bag, which after folding is positioned at the top of the folded bag.

One problem facing the traveler who carries a garment bag is the tendency of the hanging garments to wrinkle when the bag is folded. Since it is often inconvenient or impossible to maintain the bag in its elongated condition, attempts have been made to alleviate the problem. Probably the most successful of these attempts is disclosed in U.S. application Ser. No. 673,351, filed on Nov. 23, 1984 in the name of William L. King et al, now U.S. Pat. No. 4,662,513 which provides a number of features designed to better hold the clothes in place. Corner compartments are provided for receiving small items of clothing or accessories to avoid having to clump such items at the bottom of the bag. A stay bar is provided at the midpoint of the elongated bag so that hanging garments will tend to fold or drape smoothly over the bar when the bag is folded, as opposed to bunching toward the center of a cinch strap commonly provided for this purpose across the center of the bag.

The King et al application further provides cross straps connected at one end to the corner compartments and at the other to the stay bar. The cross straps hold the garments against their hangers in order to restrain the garments against sliding or falling downwardly when the garment bag is folded. In addition, straps are provided at the bottom portion of the bag to hold in place the folded end portions of long garments to prevent them from clumping at the bottom of the bag.

Although these various features have resulted in a greatly improved garment bag, nevertheless there are still areas in which improvements can be made. At times it would be helpful if the corner compartments were able to hold larger items than the size they were originally designed to receive. It would also be more convenient not to have to contend with the stay bar at all when hanging garments in the bag. As designed, the stay bar is simply moved up out of the way, such as to the top panel of the garment bag, when packing clothes in the bag. Even this minor step, however, can be an annoyance to some people.

Further, the necessity to turn the garment bag around when using the storage pockets can be not only bothersome but difficult, particularly when the contents of the bag are heavy and the bag is resting on a horizontal surface or hanging against a door.

Finally, despite all the improved features added to the existing type of garment bag, some garments, particularly those with lapels, continue to have wrinkling problems. This is caused to a large extent by the manner in which garment bags are packed. Most people insert their garments into the bag with the front of the garment exposed. This natural inclination allows the user to adjust the front of the garment after the hanger on which it is supported has been put in place. It also permits the garments to be buttoned or unbuttoned, permits the arms of the garments to be positioned for minimum wrinkling, and provides access to any trousers draped on the hanger. By arranging the clothes in this way, however, it often assures wrinkling of the lapels because of their tendency to wrinkle when folded over the stay bar.

It would be desirable to improve still further the features of the garment bag disclosed in the King et al application, and to provide means for reducing the wrinkling of garment lapels.

BRIEF SUMMARY OF THE INVENTION

This invention involves a flexible garment bag of a design that differs from the conventional approach of the prior art. Instead of providing a handle on the back panel to allow the folded bag to be carried in the manner of a suitcase, a handle is attached to the front access panel. When the bag is folded, the access panel thus becomes the exterior side of the folded bag and the back panel becomes the unexposed panel folded upon itself.

This arrangement results in a number of advantages. By loading garments through the access panel with their lapel side out, and then carrying the bag by a handle located on the access panel, the garments are folded about their back faces, with the lapel side facing up. As explained more fully hereinafter, the lapels are thus less likely to wrinkle than when they are facing down. In addition, by providing pockets in the access panel both the interior of the garment bag and the pockets as well can be reached from the front of the bag. The need to turn the bag over when packing is thereby obviated.

Other features are also made possible by this new arrangement. Instead of having a stay bar in the interior of the garment bag over which the hanging garments are folded, an integral folding bar or strip can be provided in the back panel. Since such a strip does not take up space in the interior of the garment bag, it does not interfere with the loading process. It also results in more usable loading space. Moreover, criss-cross straps can be attached to the sides of the bag rather than being connected to a stay bar.

Corner pockets or compartments which extend a relatively great distance into the interior of the garment bag are also provided. They not only provide more loading space for small items of clothing and accessories, but in cooperation with the closely spaced shoulder portions or arms of the hangers, they assist in holding the garments in place against the tendency to slip off the end of the hangers when the bag is in the folded condition.

Other features and aspects of the invention, as well as its various benefits, will be made more clear in the detailed description of the invention which follows.

DESCRIPTION OF THE INVENTION

Figure 6:
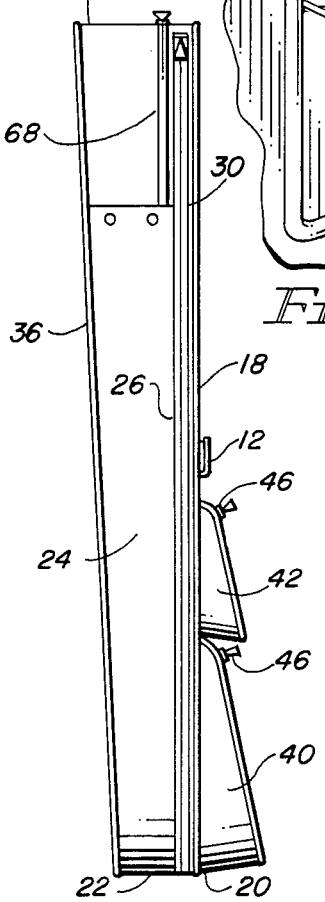
FIG. 6 is a side elevational view of the garment bag of FIG. 2.

Referring to FIGS. 1, 2, 3 and 6, the flexible garment bag 10 of the present invention is shown as having a handle 12 attached by rivets 14 or other suitable fastening means to the central portion 16 of the access panel 18. The lower edge of the access panel 18 is foldably or flexibly attached at 20 to the front edge of the bottom panel 22 so that the access panel can be folded down about the flexible connection when it is opened. The vertical edges of the access panel are detachably connected to the side panels 24 by suitable fasteners such as zippers 26 which continue around the peripheral edges 30 of the upper portions of the access panel 18 adjacent to corner pockets 28. The access panel is attached to the upper panel 32 when in closed condition by suitable attachment means such as the strap and buckle arrangement 34, shown in FIG. 2. Any other fastening means capable of being easily connected and disconnected could be used instead, as desired. Thus, as shown in FIGS. 2, 4A, 4B, 6, and 8, the access panel 18 comprises the major portion of the front panel of the garment bag when in the closed condition and exposes at least the major portion of the interior space of the garment bag when it is opened. As shown in FIG. 6, the back panel 36 is connected to and extends between the top and bottom panels 32 and 22.

Except for the top panel 32 and the central portion 16, all the panel portions described thus far are comprised of fabric or fabric-like material. The side panels 24 consequently can be considered to be gusset panels. The central portion 16 may be comprised of any stiff material strong enough to withstand the stresses distributed through it when the folded bag is lifted by the handle 12. Similarly, the top panel 32 can be made of stiff material in order to withstand the stresses produced when the bag is lifted or supported by the hook 38, shown in FIG. 2, which is attached by suitable means to the top panel 32. It should be understood that the stiff material of the top panel 32 or central portion 16 need not be exposed, but may for the sake of appearance be covered by the same fabric that makes up the other flexible panels.

Figures 1, 2, 3, 4A:
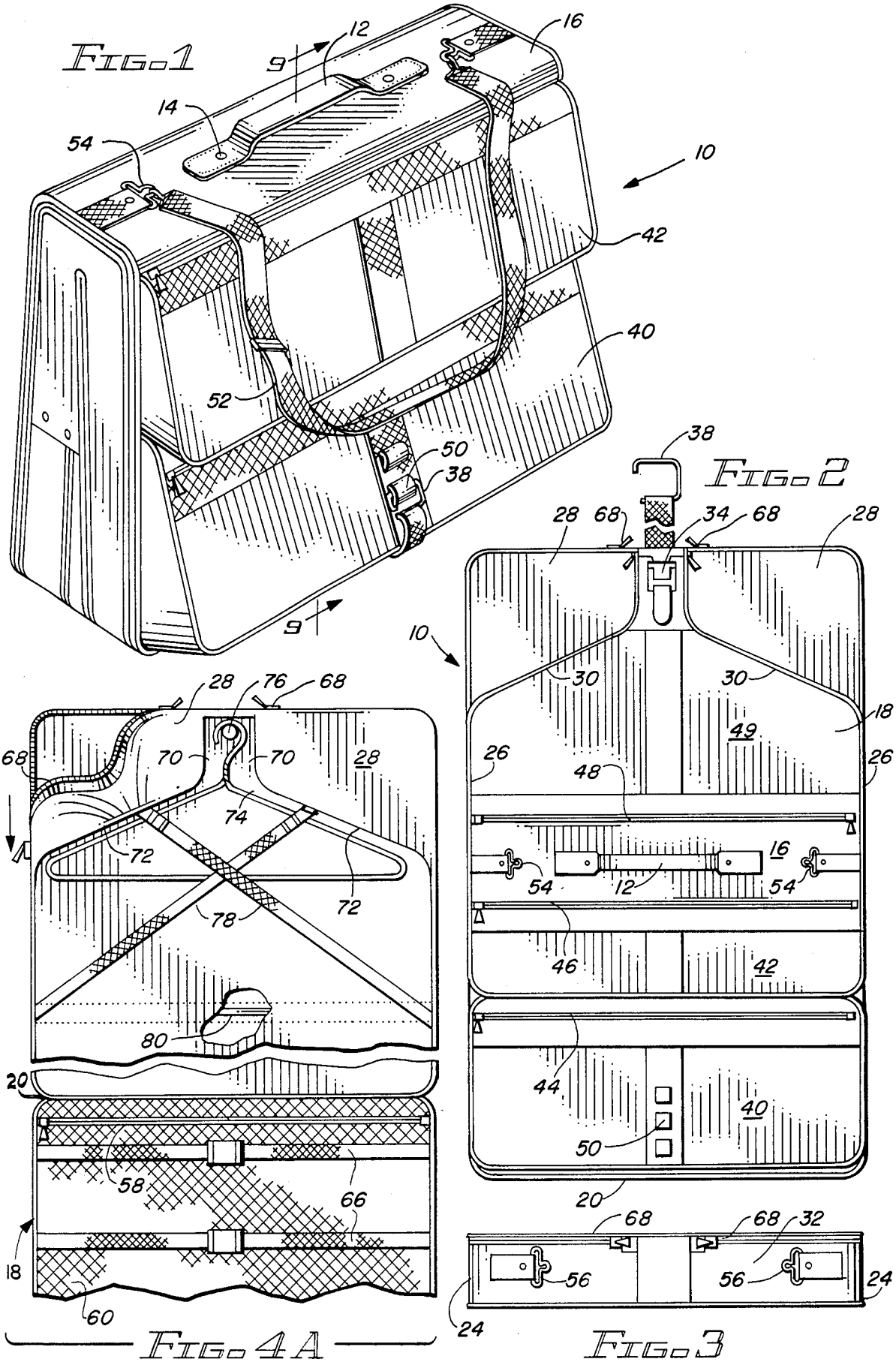
FIG. 1 is a pictorial representation of the flexible garment bag of the present invention shown in its folded condition.
FIG. 2 is a front elevational view of the garment bag of FIG. 1, shown in its vertical elongated condition with the access panel closed.
FIG. 3 is a plan view of the top of the garment bag.
FIGS. 4A and 4B, when taken together, are a front elevational view of the garment bag of FIG. 2, shown with the access panel open, with a portion of the length of the bag removed for ease of illustration.

As shown in FIGS. 1, 2 and 6, gusseted pockets 40 and 42 are connected to the lower portion of the access panel 18, the lowermost pocket 40 being provided with a zipper opening and closing means 44 and the pocket 42 being provided with a similar zipper means 46. When the garment bag is in its folded condition, as shown in FIG. 1, the pockets comprise one exposed side of the folded bag. Zipper means 48, shown in FIG. 2 just above the central portion 16 of access panel 18, provides entry to a non-gusseted pocket 49 in the upper portion of the access panel 18.

As shown in FIG. 1, the garment bag support hook 38 has been inserted in loop 50 located on the front lower face of the pocket 40. Depending on how full the garment bag has been packed, the hook 38 will best fit in one of the three loops illustrated. This arrangement serves to both hold the hook in place and hold the bag in folded condition. Obviously, the number of loops provided and their spacing can be varied according to preference.

The shoulder strap 52 is shown in FIG. 1 as being attached to clips 54 to allow the bag to be carried by the shoulder strap when in folded condition. The strap can be attached instead to the clips 56, shown in FIG. 3 as being located at the outer edges of the top panel 32, to facilitate carrying the bag in its elongated vertical condition or, if desired, the strap 52 can be removed entirely.

Figure 4B:
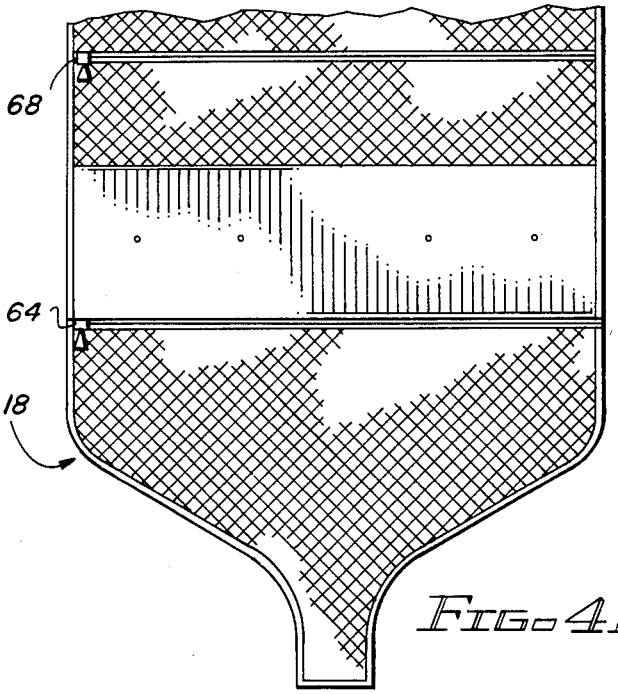

Referring to FIGS. 4A and 4B, the bag is shown in its vertical position with the access panel 18 open, supported at the foldable connection 20. A zipper connection 58, shown just below the foldable connection 20, permits access to the pocket 40 through the interior lining 60 of the pocket. In like manner, zipper connections 62 and 64 provide access to the pocket 42 and to the non-gusseted pocket 49 through the same lining 60. The lining 60 is shown as being comprised of mesh material, preferably a non-slip material, to not only permit access to the pockets from the inside of the access panel, but to expose the contents to view from the inside of the access panel. It should be understood that although no pockets are shown in the back panel of the bag, such pockets could readily be provided, with similar inside access through a mesh interior lining material if desired.

As in the aforementioned King et al application, straps 66 can be provided in the lower interior portion of the access panel 18 to hold in place the lower portions of long garments which extend down beyond the flexible connection 20.

Referring to FIG. 4A, the corner pockets 28 are shown as comprising part of the front panel of the garment bag but not part of the access panel. Zipper connections 68 are provided to open and close the corner pockets along the upper portions of the pockets adjacent the top panel 32 and also along the outer vertical portions of the pockets adjacent the side panels 24. These connections are also shown in FIGS. 2, 3 and 6. For purpose of illustration, the left corner pocket is shown as being partially open in FIG. 4A. The inner portions of the pockets 28 are defined by generally vertical sections 70 extending downwardly from the top panel a substantial distance, and diagonal sections 72 extending from the bottom of the vertical section to the side panels 24.

As can be seen in FIG. 4A, the vertical sections 70 are as closely spaced as practicable while still leaving enough room to enable the hooked portion of a clothes hanger 74 to be inserted between them and hung on the hanger support trolley 76. The relationship between the pocket dimensions, the hanger dimensions and the location of the hanger support 76 is such that the arms of a conventional clothes hanger will be substantially parallel to and spaced only a short distance from the diagonal sections of the pockets so that in the folded condition of the bag the bottom walls of the diagonal section 72 will prevent any significant sliding movement of clothes from the hangers on which they are supported.

Still referring to FIG. 4A, straps 78 are provided for further assisting to hold the handing garments in place to prevent slipping and wrinkling. One end of each strap is connected to a side panel of the garment bag adjacent the midpoint thereof and the other end is releasably connected, as by clips or buckles or other suitable attaching means, to the diagonal section of the oppositely located corner pocket 28. Preferably, the straps are elastic so that they can be used to secure a thick collection of garments as well as just one or two relatively flimsy garments.

Figure 5:
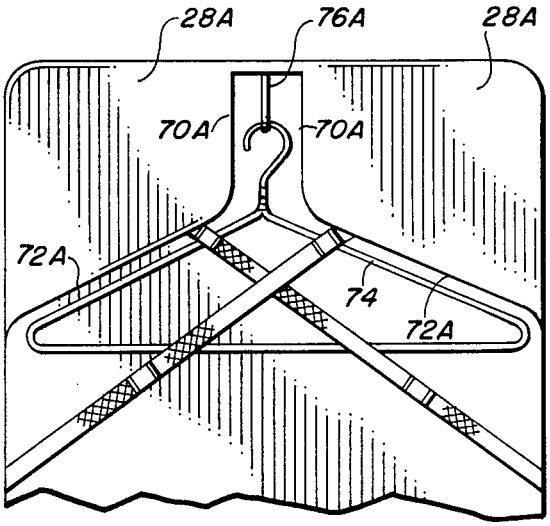
FIG. 5 is a front elevational view of the upper portion of the garment bag of FIGS. 4A and 4B, showing a modified corner pocket and hanger support arrangement.
Figure 5A:
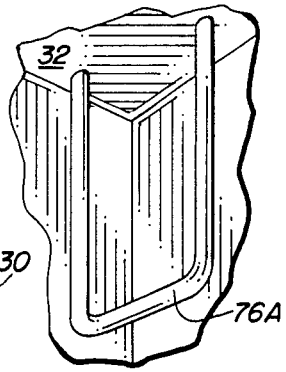
FIG. 5A is an enlarged pictorial representation of one form of hanger support which can be used with the arrangement of FIG. 5.

Referring to FIG. 5, a similar corner pocket arrangement is shown except that the vertical sections 70A of the pockets 28A are longer, extending deeper into the interior space of the garment bag. The slope of the diagonal sections 72A remains the same, so that the diagonal sections are closely spaced and parallel to the arms of a conventional hanger 74. In order to achieve the greater depth of the corner pockets, the hanger support 76A extends farther down from the top panel of the garment bag than does the hanger support 76. As shown in FIG. 5A, the support 76A may simply be an elongated U-shaped support bar extending down from the top panel 32 of the garment bag. If used as shown, the close proximity of the diagonal sections 72A of the corner pockets 28A would prevent the hanger, when the bag is carried in folded condition, from moving off the hanger support to such an extent that it would become permanently dislodged. If desired, any suitable means could be provided on the support 76A, such as a cross piece spaced a short distance from and extending parallel to the bottom portion of the U-shaped member, to more positively prevent the hanger from disengaging from the support 76A.

Figure 7:
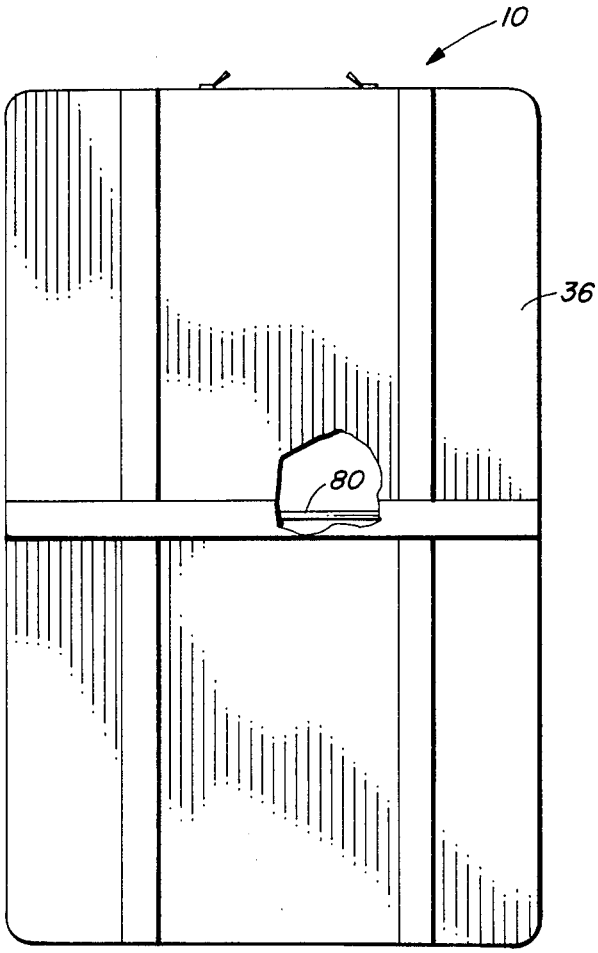
FIG. 7 is a back elevational view of the garment bag of FIG. 2.

Referring back to FIG. 4A, extending substantially parallel to the flexible connection 20 is a folding bar or rod 80 located generally at the midpoint of the back panel of the garment bag. The rod is shown as being held in place between spaced rows of stitching 82 and 84 which connects the inner lining and the exterior face of the back panel. It is also shown in the view of the back panel 36 in FIG. 7. Preferably, the rod is arcuate in cross section to reduce the tendency of garments hanging inside the bag to wrinkle when they are folded about the rod as the bag is folded to its closed condition. One type of arcuate rod configuration which has been found to perform well is formed from a foam-covered wooden rod. Although such a design is preferred for reasons of performance, material availability and economy, obviously other materials or combinations of materials could also be used.

Figure 8:
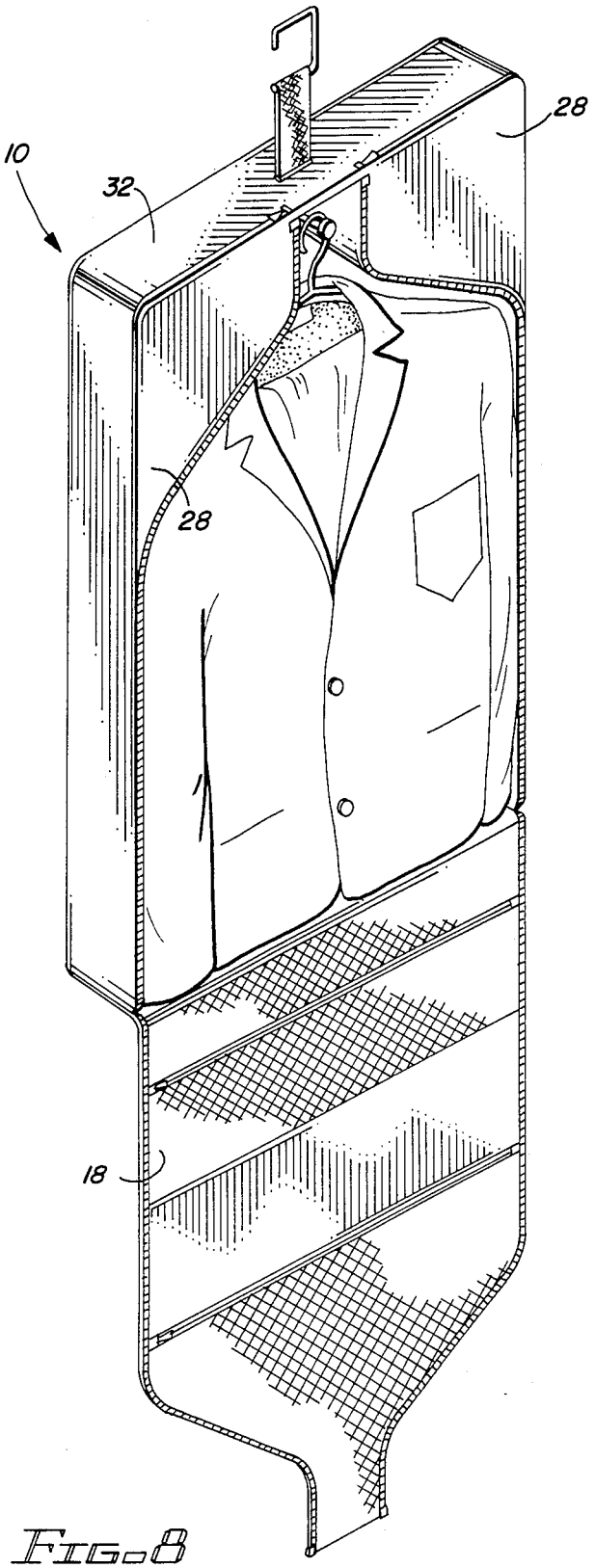
FIG. 8 is a pictorial representation of the garment bag of the present invention, shown with garments hanging therein.

In use, garments on hangers are inserted through the space vacated by the open access panel 18 until the garment bag 10 is loaded. The garment bag in this condition is illustrated in FIG. 8, with the fronts of the garments facing outwardly. The gusseted pockets 40 and 42, and the ungusseted pocket 49 may be packed at this time through zippered closures 58, 62 and 64, respectively (see FIGS. 4A and 4B). The corner pockets 28 are also accessible from the front of the bag and may be conveniently packed at this time. Of course if the back panel 36 has pockets as referred to before, these may also be packed through zippered closures provided in the back panel 36, preferably before the hanging clothes are placed in the bag.

Figure 9:
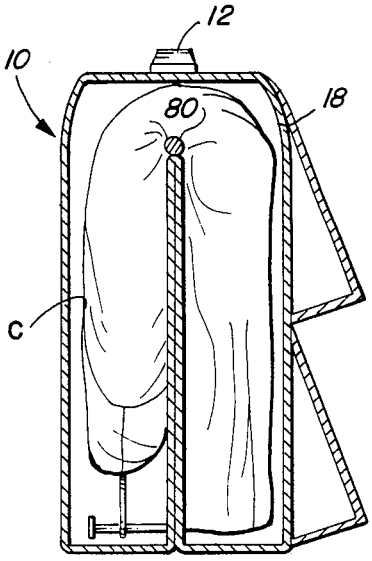
FIG. 9 is a sectional view of the folded garment bag of the present invention, taken along line 9—9 of FIG. 1.

As shown in FIG. 9, when the packed garment bag is folded the clothes C are folded about the fold bar or rod 80. As a result the fronts of the garments, which includes the lapels, are folded about a larger radius than the backs of the garments. A benefit of this larger folding radius is that the fabric in the fronts of the garments is placed in slight tension around this larger radius. This enables the lapels and the garment fronts, which are normally more bulky and susceptible to wrinkling than the backs of the garments, to come through the folding process with less danger of being wrinkled.

As noted earlier, the benefits resulting from the new garment bag design of the present invention are many. Garments can be packed with the front side out with reduced likelihood of wrinkling the lapels. The garment bag can be packed entirely from the front of the bag, by using the pockets in the access panel and, if present, the inside pockets of the back panel. Garments can be held in place by the criss-cross straps and also held against slipping off the hangers when the bag is in folded condition by the proximity of the corner pockets. The corner pockets themselves can be made extra deep to hold more items or larger accessories, yet standard hangers can be used. Further, the garments are folded about a built-in fold bar which does not take up any space in the interior of the garment bag.

It should be obvious that although a preferred embodiment of the invention has been described, changes to certain specific details of the preferred embodiment can be made without departing from the spirit and scope of the invention as defined in the accompanying claims.

What is claimed is:

1. In a flexible garment bag having an enclosed interior space for receiving garments:

access panel means having a size such that, when closed, said access panel means comprises at least a major portion of the front panel of the garment bag;

means flexibly connecting the access panel means along an edge portion thereof to the garment bag;

means for detachably connecting other edge portions of the access panel means to the garment bag so that when the detachable connection is open, the access panel means can be opened to provide an opening through which garments can be inserted into and removed from the interior space of the garment bag, and when the detachable connection is closed, the inside face of the access panel means defines a portion of the enclosed interior space; and handle means attached to the outer face of the access panel means to enable a user to carry the bag in the manner of a suitcase.

2. A flexible garment bag according to claim 1, wherein the enclosed interior space has an upper portion and a lower portion, the garment bag including additionally hanger support means generally centrally located in the upper portion of the enclosed interior space for receiving clothes hangers, and diagonal pockets in the upper corners of the enclosed interior space for receiving accessories and the like.

3. A garment bag according to claim 2, wherein the diagonal portions of the diagonal pockets extend generally parallel to and are spaced a short distance from the arms of clothes hangers supported on the hanger support means, whereby the lower portions of the diagonal pockets assist in holding in place the shoulder portions of clothes carried by the hangers.

4. A garment bag according to claim 2, including additionally two straps attached to the interior of the garment bag, one end of each strap extending from one of the diagonal pockets to the opposite side of the interior space, so as to criss-cross garments hanging on clothes hangers to assist in holding the garments in place.

5. A garment bag according to claim 1, wherein the access panel means contains at least one pocket therein.

6. A garment bag according to claim 5, including additionally first means located on the outer face of the access panel means for opening and closing the pocket, and second means located on the inside face of the access panel means for opening and closing the pocket.

7. A garment bag according to claim 6, wherein the portion of the pocket on the inside face of the access panel is comprised of mesh material through which the user can see the contents of the pocket when the access panel means is open.

8. A flexible garment bag, comprising:

a front panel;

a back panel;

means connecting the front and back panels in spaced relationship to each other to form an enclosed elongated interior space for receiving garments;

access panel means comprising at least a major portion of the front panel;

the access panel means having flexible connecting means along a portion of the perimeter thereof, enabling the access panel means to be folded back along the flexible connecting means to permit garments to be inserted into or removed from the interior of the garment bag;

the access panel means having detachable connecting means on other portions of the perimeter thereof; and handle means on the outer face of the access panel means located generally centrally of the front panel, whereby the back panel of the flexible garment bag can be folded upon itself transversely of the elongated interior space and the folded garment bag can be carried by the handle means.

9. A flexible garment bag according to claim 8, wherein the back panel contains a relatively narrow rigid portion extending transversely of the garment bag and located substantially opposite the location of the handle means when the access panel is closed, whereby when the garment bag is folded, garments hanging in the elongated interior space will be folded generally about the relatively narrow rigid portion.

10. A flexible garment bag according to claim 9, wherein the rigid portion comprises a rod held in place on the interior side of the flexible material of the back panel.

11. A flexible garment bag according to claim 8, wherein the means connecting the front and back panels in spaced relationship comprises relatively narrow top, bottom and side panels, and the access panel means comprises a panel flexibly connected to the bottom panel.

12. A flexible garment bag according to claim 11, including additionally at least one strap extending across the width of the inside face of the access panel to hold down the bottom portions of long garments.

13. A flexible garment bag according to claim 11, wherein the access panel contains at least one pocket therein, the pocket being accessible from both the outer and inside faces of the access panel.

14. A flexible garment bag according to claim 11, including additionally bag hanger means connected to the top panel of the garment bag for supporting the bag in elongated vertical condition, and means adjacent the bottom panel for receiving the bag hanger means to hold the garment bag in folded condition.

15. A flexible garment bag according to claim 14, wherein the bag hanger means comprises a hook, and the means adjacent the bottom panel for receiving the hanger means comprises a plurality of spaced loops, the hook being adapted to fit into one of the loops.

16. A flexible garment bag according to claim 11, including additionally a corner pocket in each of the upper corners of the garment bag, the interior surfaces of the corner pockets extending generally vertically downwardly from the top panel for a substantial distance, the generally vertical surfaces being spaced from each other on opposite sides of a hanger support means, and the interior surfaces of the corner pockets extending diagonally from the lower extremity of the vertical surface to the nearest side panel, the corner pockets being arranged so that the diagonal interior surfaces are spaced a short distance from and are generally parallel to the arms of a coat hanger supported on the hanger support means to assist in holding in place garments supported on the arms of the hanger.

17. A flexible garment bag according to claim 16, wherein the side edges of the access panel are detachably connected to the side panels, and the upper edges of the access panel are detachably connected to the corner pockets adjacent the interior surfaces thereof.

18. A flexible garment bag according to claim 16, including additionally two straps having upper and lower ends, the upper ends of the straps being attached to the diagonal interior surfaces of the corner pockets and the lower ends of the straps being attached to the interior of the garment bag adjacent the opposite sides thereof.

19. A flexible garment bag according to claim 18, wherein the lower ends of the straps are fixedly attached and the upper ends are removably attached.

20. A flexible garment bag comprising an enclosed interior space for receiving garments, said interior space being defined at least in part by a front panel:

an access panel for providing entry into the interior space, said panel when closed defining at least a major portion of said front panel;

the access panel when closed defining a portion of the interior space; and handle means on the outer face of the access panel to enable the garment bag, when folded, to be carried like a suitcase.

21. A flexible garment bag comprising an enclosed interior space for receiving garments, said interior space being defined at least in part by a front panel;

an access panel for providing entry into the interior space the access panel when closed defining at least a major portion of said front panel;

the access panel when closed defining a portion of the interior space; and means for carrying said garment bag in a folded position with the access panel facing outward, and a relatively narrow rigid portion extending transversely of the garment bag and located substantially opposite the location of said means for carrying when said access panel is closed and the garment bag is in said folded position.

* * * * *

UNITED STATES PATENT AND TRADEMARK OFFICE

CERTIFICATE OF CORRECTION

PATENT NO. : 4,736,839

DATED : April 12, 1988

INVENTOR(S) : William L. King

It is certified that error appears in the above—identified patent and that said Letters Patent is hereby corrected as shown below:

On the cover page of the patent in the "References Cited" Section, after the cited reference "3,512,621" (Teetor), insert:

-- 3,737,013 6/1973 Powell --

Cancel the subject matter appearing in Column 8, Line 66, through Column 10, Line 6 (Claim 21), and add the following beginning at Column 8, Line 66:

-- 21. A flexible garment bag according to claim 20, wherein said handle means is fastened to a central portion of said access panel, said central portion including a stiff material strong enough to withstand the stresses distributed through it when the folded bag is lifted by said handle means.

22. A flexible garment bag according to claim 20, wherein said handle means is a handle.

UNITED STATES PATENT AND TRADEMARK OFFICE

CERTIFICATE OF CORRECTION

PATENT NO. : 4,736,839

DATED : April 12, 1988

INVENTOR(S) : William L. King

It is certified that error appears in the above-identified patent and that said Letters Patent is hereby corrected as shown below:

23. A flexible garment bag according to claim 20, wherein said handle means is a shoulder strap. --

Signed and Sealed this

Twenty-first Day of February, 1989

*Attest:*

*Attesting Officer*

DONALD J. QUIGG

*Commissioner of Patents and Trademarks*